US010118407B2

(12) United States Patent
Salerno

(10) Patent No.: US 10,118,407 B2
(45) Date of Patent: Nov. 6, 2018

(54) METHOD AND APPARATUS FOR PREPARING FOOD PRODUCT LABELS

(71) Applicant: Mark Salerno, Huntington, NY (US)

(72) Inventor: Mark Salerno, Huntington, NY (US)

( * ) Notice: Subject to any disclaimer, the term of this patent is extended or adjusted under 35 U.S.C. 154(b) by 0 days.

(21) Appl. No.: 14/159,731

(22) Filed: Jan. 21, 2014

(65) Prior Publication Data

US 2014/0204401 A1 Jul. 24, 2014

Related U.S. Application Data

(60) Provisional application No. 61/755,097, filed on Jan. 22, 2013.

(51) Int. Cl.
*B41J 3/407* (2006.01)
*B41J 3/46* (2006.01)

(52) U.S. Cl.
CPC ..... *B41J 3/4075* (2013.01); *B41J 3/46* (2013.01)

(58) Field of Classification Search
CPC ..... B41J 3/4075; B41J 3/46
USPC ..... 358/1.6
See application file for complete search history.

(56) References Cited

U.S. PATENT DOCUMENTS 4,264,396 A * 4/1981 Stewart ..... B41J 2/32 101/288
5,243,579 A 9/1993 Potthof ..... 368/107
2001/0032441 A1 10/2001 Ogden et al. ..... 53/411
2002/0016739 A1* 2/2002 Ogasawara ..... G06K 17/00 705/22
2002/0129892 A1* 9/2002 Brown ..... G07F 9/02 156/277
2004/0085225 A1* 5/2004 Wilson ..... B42D 15/0053 340/870.16
2004/0100380 A1 5/2004 Lindsay et al. ..... 340/540
2007/0057050 A1* 3/2007 Kuhno ..... G02B 27/62 235/383
2007/0214053 A1* 9/2007 Salerno ..... G06Q 10/087 705/15
2009/0037283 A1* 2/2009 Anderson ..... G06Q 10/087 705/15

FOREIGN PATENT DOCUMENTS

GB 2 406 308 3/2005 ..... B41J 3/407

OTHER PUBLICATIONS

The International Search Report dated May 9, 2014 and the Written Opinion of the International Searching Authority dated May 9, 2014, issued by the U.S. Patent and Trademark Office for Applicant's corresponding PCT/US2014/012286, filed on Jan. 21, 2014.

(Continued)

*Primary Examiner* — Neil R McLean
*Assistant Examiner* — Darryl V Dottin
(74) *Attorney, Agent, or Firm* — Bodner & O'Rourke, LLP; Gerald T. Bodner; Christian P. Bodner

(57) ABSTRACT

A food product rotation label device for preparing food product labels includes a microcontroller circuit, a display and a thermal printer. The thermal printer prints food product labels for attachment to food products. The display displays a list of food product label information relating to food product labels printed by the thermal printer and food products on which the food product labels are used.

47 Claims, 12 Drawing Sheets

(56) References Cited

OTHER PUBLICATIONS

Communication Pursuant to Rule 62 EPC, in English, dated Feb. 22, 2017, enclosing the extended European Search Report and supplementary European Search Report which was issued by the European Patent Office in Applicant's corresponding European Patent Application having Serial No. 14 743 828.7, filed on Aug. 17, 2015.
The extended European Search Report, in English (dated Feb. 22, 2017—mailed with the Communication Pursuant to Rule 62 EPC), which was issued by the European Patent Office in Applicant's corresponding European Patent Application having Serial No. 14 743 828.7, filed on Aug. 17, 2015.
The supplementary European Search Report, in English (dated Feb. 22, 2017—mailed with the Communication Pursuant to Rule 62 EPC), which was issued by the European Patent Office in Applicant's corresponding European Patent Application having Serial No. 14 743 828.7, filed on Aug. 17, 2015.

* cited by examiner

*Product Rotation Label System*
*Hardware Block Diagram*

*Main Software loop*

Print Label Check

Expired Product Alert Check

*Display Product Holding List*

*Display Product Holding List and Discard Alert*

*Remove Products from Active Label List*

*Batch Printing Block Diagram*

*User Interface Batch Printing*

*Preparation List Display*

*Preparation List User Interface*

*Remote Information display*

*Label Compliance System*

*Dual Day of Week Label*

164

163

Label Compliance Report 7 days Compared to previous week with a 30% Allowable Variance

160

| Store | 30-May | 29-May | 28-May | 27-May | 26-May | 24-May |
|---|---|---|---|---|---|---|
| 300 | 233/345 | 165/353 | 460/322 | 294/294 | 392/328 | 669/251 |
| 162 | 199/292 | 340/279 | 415/256 | 303/244 | 250/242 | 324/201 |

161

162

*Dual Day of Week Label*

METHOD AND APPARATUS FOR PREPARING FOOD PRODUCT LABELS

CROSS-REFERENCE TO RELATED APPLICATIONS

This application is related to U.S. Provisional Patent Application Ser. No. 61/755,097, which was filed on Jan. 22, 2013, and is entitled "Method and Apparatus for Preparing Food Product Labels", the disclosure of which is hereby incorporated by reference and on which priority is hereby claimed.

BACKGROUND OF THE INVENTION

Field of Invention

This invention relates generally to devices that print food product rotation labels. When food is prepared in a commercial food service environment and placed into containers for short term storage, the containers are labeled for reasons of food safety and quality. The labels that are applied to the containers are called food product rotation labels. Devices that are utilized to print these labels are Product Rotation Label Printers.

Description of the Prior Art

Food product rotation labels have been in common use in the food service industry for over 50 years. They are marked with the date and time the product was prepared and often marked with the time and date to discard the product for reasons of food safety and quality. The first product rotation labels were hand written by food service workers and affixed to the food containers. The labels would often contain preparation time, discard date and discard time and user initials. Food service workers would inspect the labels and discard the product if the food reached the discard date and time.

In the late 1990's, small embedded devices and low cost direct thermal label printers were combined to allow users to more easily and efficiently produce labels. Today, devices are programmed with product lists containing hold time and any additional information such as container contents, bar codes or information the user finds useful. Generally, using a display and keypad, the user selects a product label to print from a product list. Using an internal real time clock and the hold time supplied from the product list, the device calculates the discard date and time and prints the discard date and time on the label along with other information. Multiple devices exist in the industry today that contain the above features.

After the labels are printed and affixed to the food containers, food service workers routinely forget to inspect the labels for expired food products. Therefore, it would be advantageous to provide a device with hardware and software that will store a list of labels printed along with the discard time, and when a particular container expires, create an audible and visual alert to indicate that a food product has expired.

Food service workers generally are instructed to prepare a quantity of food that attempts to minimize waste. That means that most of the products prepared and labeled are served to guests. Therefore, it would be advantageous to provide software and a user interface that allow the user to quickly and efficiently remove products that have been served from the list of printed labels. This feature would prevent discard alerts of products that are no longer being held.

Commercial kitchens often have standard groups of products that need to be labeled on a daily basis, such as bottles of sauces or condiments. Therefore, it would be advantageous to provide software and an operator interface that allow a user to segregate a portion of the product list, called a station, and batch print all the product rotation labels in that station with one key press.

Food service workers are generally instructed to prepare multiple types and differing quantities of food throughout the day using a printed report called a preparation list, or "prep list" for short. This printed prep list is typically generated by the creation of a forecast based on the current menu and previous sales. The paper report is utilized by the kitchen staff as instructions to the time, product and quantity to prepare. This paper report which must be posted can become contaminated with raw food when handled, causing a cross-contamination food safety issue. Additionally, keeping track of what products are prepared depends on the kitchen staff notating the paper prep list. Management needs to review the report and inspect that the products have been prepared. This process is inefficient. Therefore, it would be advantageous to provide a feature in the device that accepts the food preparation list electronically through the facility's local network. The display on the device would then present the prep list to the kitchen staff. When a product is selected from the list and the product rotation label is printed, the list would automatically be annotated with a check mark or the like, indicating that the product has been prepared. Management can then review the screen to insure products are being prepared in a timely fashion.

Managers of large commercial kitchens are extremely busy insuring food is being prepared timely and efficiently. To insure preparation is being accomplished requires the manager to perform a physical inspection. Therefore, it would be advantageous if the status of the prep list screen can be remotely accessed via the facility's Ethernet network and the current list with the status of the prep list be played on a dashboard or hand held device.

Printing and applying product rotation labels are an important part of food safety. Many times food service workers do not follow procedure and properly label all the containers of food. Standard practice in the industry is to utilize management to perform a physical inspection to assure that product rotation labels are being generated and applied. Large enterprises that have multiple sites have difficulty in inspecting and generating timely and accurate product rotation label compliance reports. Therefore, it would be advantageous to provide a system that would log each label printed and send the log to a web database, allowing a compliance report to be generated. The database can be programmed to calculate the acceptable number of labels utilized. The label compliance report would then highlight sites that fall below the acceptable compliance limit. These sites would then be coached to bring them up to label compliance standards.

It is common in the food industry to use a label that contains a color that represents the day the product was prepared or the day it will expire. Every day users are instructed to look for a specific color of a label. An example is when products that had been labeled with a green label have expired, users look for all the green labels and discard the products. The automated printing systems use a label containing seven colored boxes pre-printed at the top of the label. The colored boxes are imprinted with the letters of the day of the week for quick reminders. The printer will black out six of the colored boxes and leave one box, exposing the color which represents the day the product needs to be discarded or the color represents the day the product is prepared. Currently, customers need to choose if they want to use the colors to represent the prep day or the discard day. Therefore, it would be advantageous to print a row of colored boxes at the top of the label, and a row of colored boxes at the bottom of the label and then using the automated printing system, mark the top row with the date prepared and the bottom row with the color of the day to discard.

OBJECTS AND SUMMARY OF THE INVENTION

It is an object of the present invention to provide a system that will store the list of printed product rotation labels and monitor the list when the products reach their expiration time and then create an audible and visual alert that a food product has expired.

It is another object of the present invention to provide software and a user interface that allow the user to quickly and efficiently remove products that have been served or discarded from the list of printed labels that are no longer being held.

It is yet another object of the present invention to provide software and hardware in the device that allow the user to segregate a list of products and the ability to batch print the labels in the segregated list with one keystroke.

It is a further object of the present invention to provide software and hardware in the device that accept a food preparation list electronically and display the food preparation list to the kitchen staff, and when a product is selected from the list and the product rotation label is printed, automatically annotate the list with a check mark or the like, indicating the product has been prepared.

It is an object of the present invention to provide software and hardware that allow the status of the preparation list to be electronically retrieved through an Ethernet network so it can be displayed on a remote dashboard or handheld device.

It is another object of the present of the invention to provide a system of hardware, software and web reports that informs the user of the level of labeling compliance across an enterprise.

It is yet another object of the present invention to provide a pre-printed label with dual color-coded boxes or the like at the top and bottom of the label and to provide software that will print black boxes or the like to correctly block all colored boxes except the box that represents the preparation day at the top of the label, and software that will print black boxes or the like to correctly block off all colored boxes except the box that represents the discard day at the bottom of the label.

In accordance with one form of the present invention, a food product rotation label device, or system, includes a microcontroller circuit, a display electrically coupled to the microcontroller circuit, and a thermal printer, also electrically coupled to the microcontroller circuit. The thermal printer prints food product labels for attachment to food products. The display displays information to a user of the food product rotation label device relating to the preparation of food product labels. This information preferably includes a list of food product label information relating to food product labels printed by the thermal printer and food products on which the food product labels are used so that the user of the device may easily view what labels are printed and for what food products. The list also preferably includes the expiration times when the food products on which the food product labels are used should be discarded.

These and other objects, features and advantages of the present invention will be apparent from the following detailed description of illustrative embodiments thereof, which is to be read in connection with the accompanying drawings.

DETAILED DESCRIPTION OF THE PREFERRED EMBODIMENTS

Figure 1:
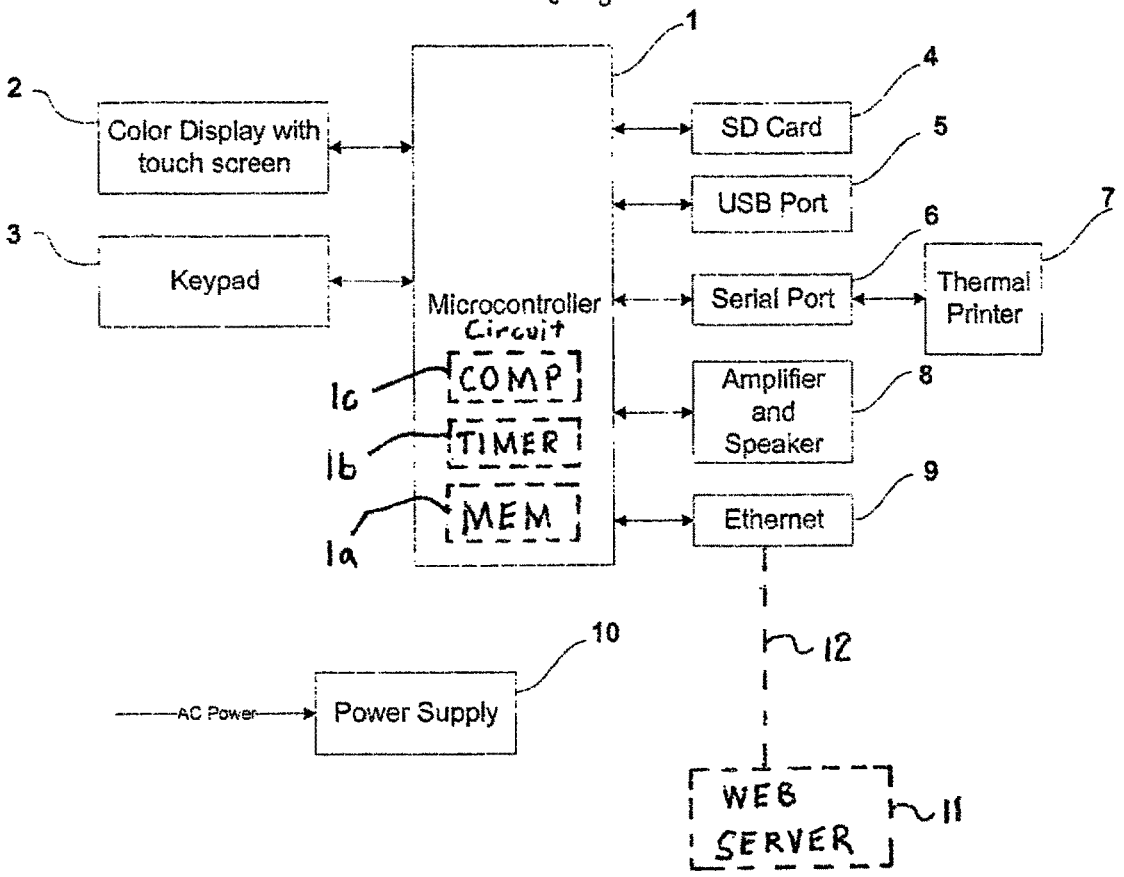
FIG. 1 is the Product Rotation Label System Hardware Block Diagram formed in accordance with the present invention.

Detailed Description of FIG. 1—Product Rotation Label System Block Diagram

The food product rotation label device, or system, of the present invention has several components, as shown in FIG. 1, including a microcontroller circuit 1. The microcontroller circuit 1 is a typical device or circuit found in the industry. It contains the CPU, one or more memories 1*a*, such as a non-volatile flash memory for holding the program and a RAM for temporary storage of variables, and a real time clock and a display driver. As will be seen, the microcontroller circuit 1 effectively includes a countdown timer circuit 1*b* and a comparator circuit 1*c* which are used in determining whether food products on which labels are placed have reached their expiration time and should be discarded. The microcontroller circuit 1 with an integrated or external display controller drives the graphics color or monochrome display 2 showing the operator various information based on the function that the user is performing A typical touch screen 2 is attached to the front of the display, allowing the user to more easily navigate the functions of the device. An external keypad 3 is utilized to allow the user to quickly return to a "home" screen, such as product selection or menu functions.

The product rotation label device, or system, also preferably includes a flash memory card port to interface with an SD card 4 or other flash memory device. The SD card 4 is utilized to store large amounts of data typically in files. These files contain the product information list files, user list files, label format files, printing log files, sound files, font files, pictures, and firmware update files.

The USB port 5 is utilized to read and write USB drives which allow product list information, user list information, and Label format information to be transferred in and out of the device locally.

The serial port 6 is standard industry hardware that connects the microcontroller 1 to the serial port of the printer 7, allowing the microcontroller circuit 1 to send printing commands and data to the printer to print labels and allows the reading of printer status.

The amplifier and speaker 8 is connected to the d/a output of the microcontroller circuit or device 1. Sound effects can be emitted from the speaker by digitizing sound at a frequency usually higher then 8 khz and then sending the digitized numbers to the d/a of the microcontroller circuit or device 1 at the same encoded frequency. This method is well known in the industry.

The Ethernet port 9 is used to communicate information in and out of the system and the SD card. Using File Transfer Protocol (FTP) or the Secure version (SFTP), the device acting as a client or server can transfer files in and out of the device. An internet and/or ethernet web server 11 is in communication with one or more product rotation label devices or systems through a data communications system, such as through an internet or ethernet connection, shown in FIG. 1 by dashed line 12.

The power supply 10 is typical in the industry and contains all the necessary circuitry to convert the line voltage to all the voltages required to supply the types of components in the device.

Figure 2A:
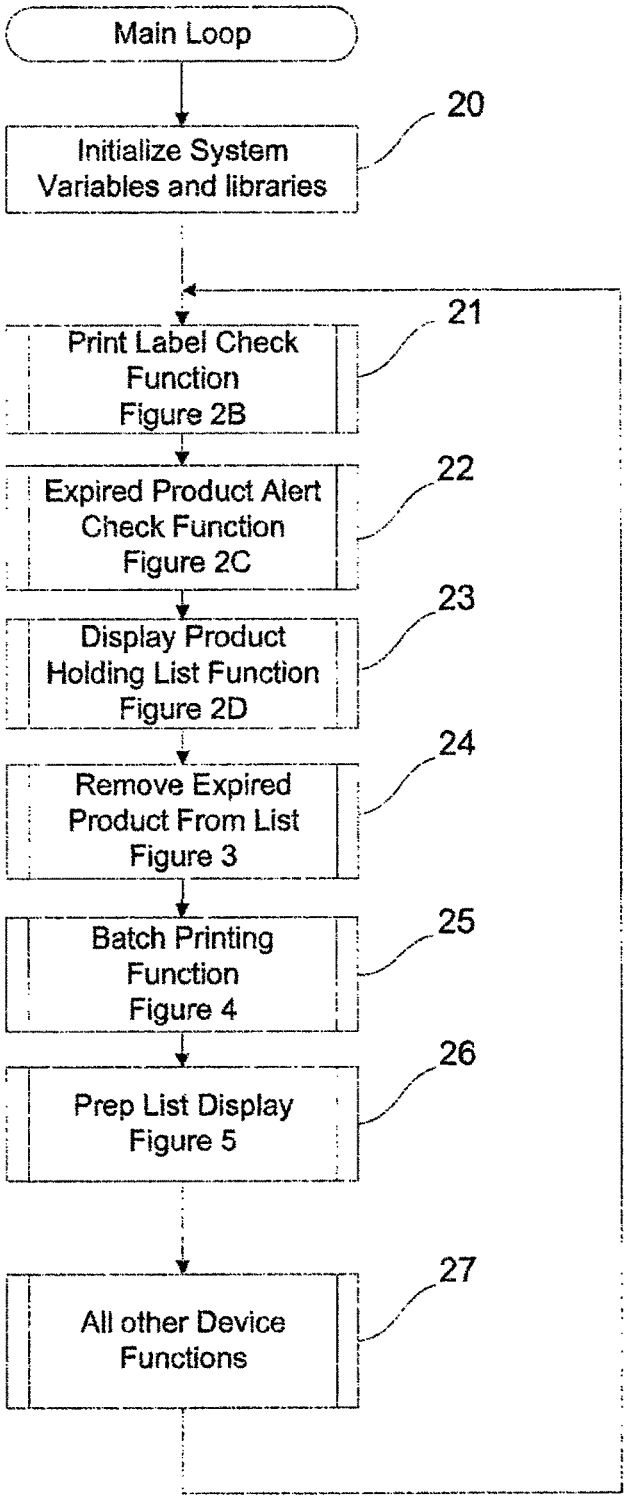
FIG. 2A is the Main Software Loop functional block diagram or flow chart formed in accordance with the present invention.

Detailed Description of FIG. 2A—Main Software Loop

There are various operating systems that are used in small electronic embedded systems devices and this is an example of a round robin operating system. The same functions can be implemented in an interrupt driven, Real time operating system. The Main Software Loop is shown in round robin form to more easily explain how the various software objects of the invention interact with each other to perform the various objects of the invention.

Block 20 shows the step of system and library variable initializations taking place. The software then goes through the main loop in a round robin fashion. The functions are typically performed very quickly so as to not miss user input or display output, and the order is typically not important to the operation of the device. Flags and messages perform the control to allow the functions to work together.

Figure 2B:
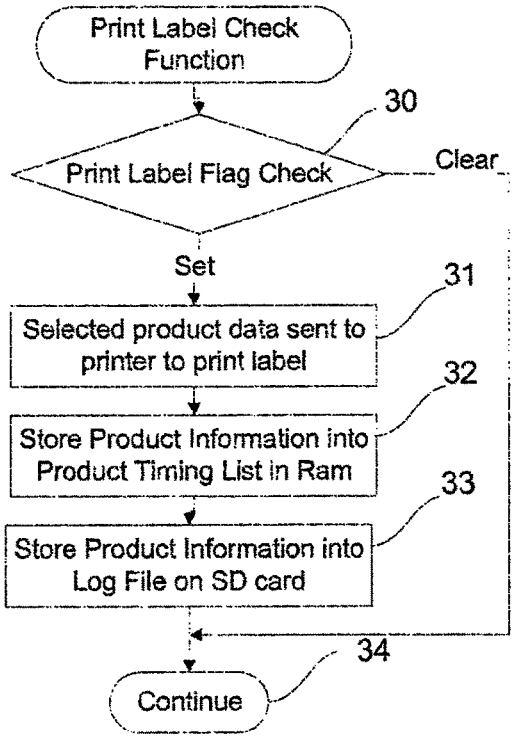
FIG. 2B is the Print Label Check software functional block diagram or flow chart formed in accordance with the present invention.

The Print Label Check Function subroutine 21 checks to see if a label needs to be printed, and if so, sends commands to the printer to properly print the selected product rotation label. FIG. 2B details this function.

Figure 2C:
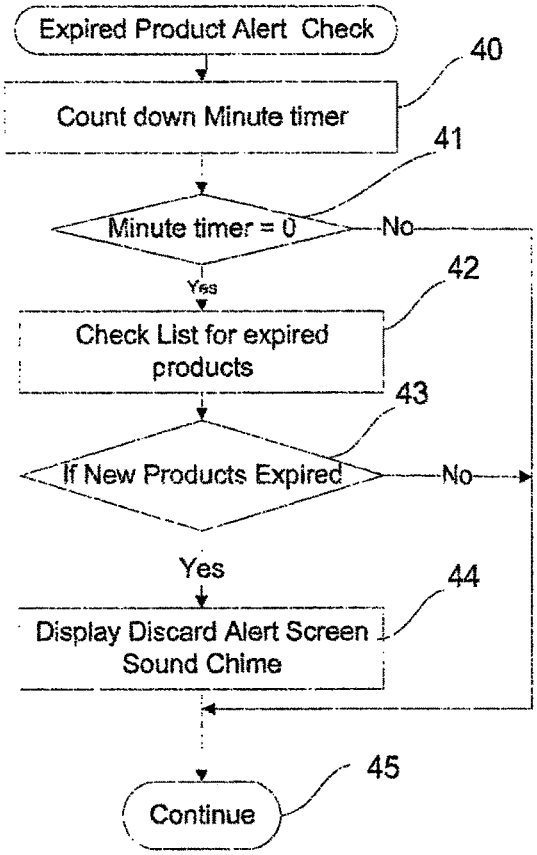
FIG. 2C is the Expired Product Alert Check functional block diagram or flow chart formed in accordance with the present invention.

The Expired Product Alert Check Function subroutine 22 checks to see if labels previously printed have expired, and sets flags to the display and alert functions. FIG. 2C details this function.

Figure 2D:
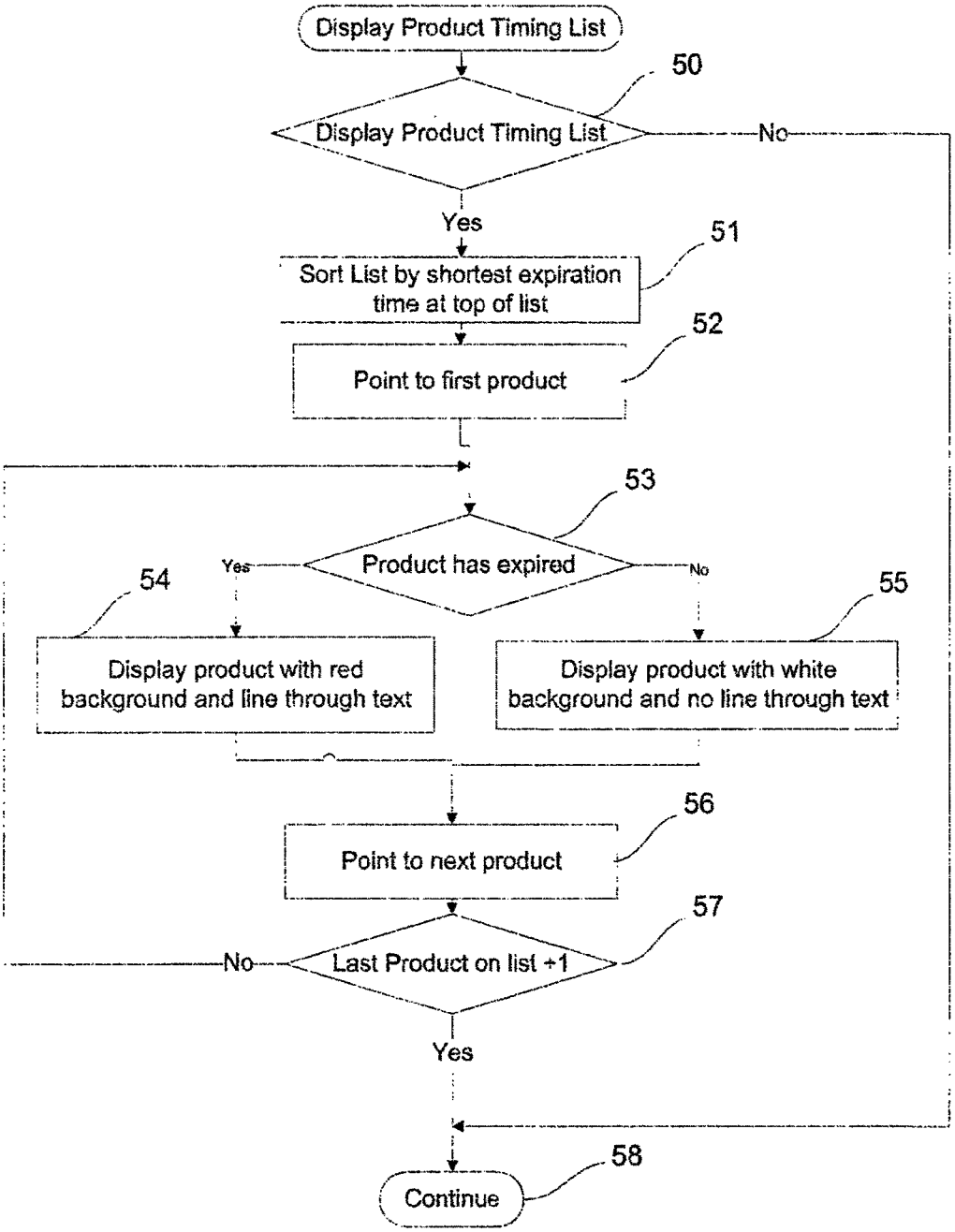
FIG. 2D is the Display Product Holding List functional block diagram or flow chart formed in accordance with the present invention.

The Display Product Holding List Function subroutine 23 checks to see if the expired product list should be displayed and how the list is displayed. FIG. 2D details this function.

Figure 3:
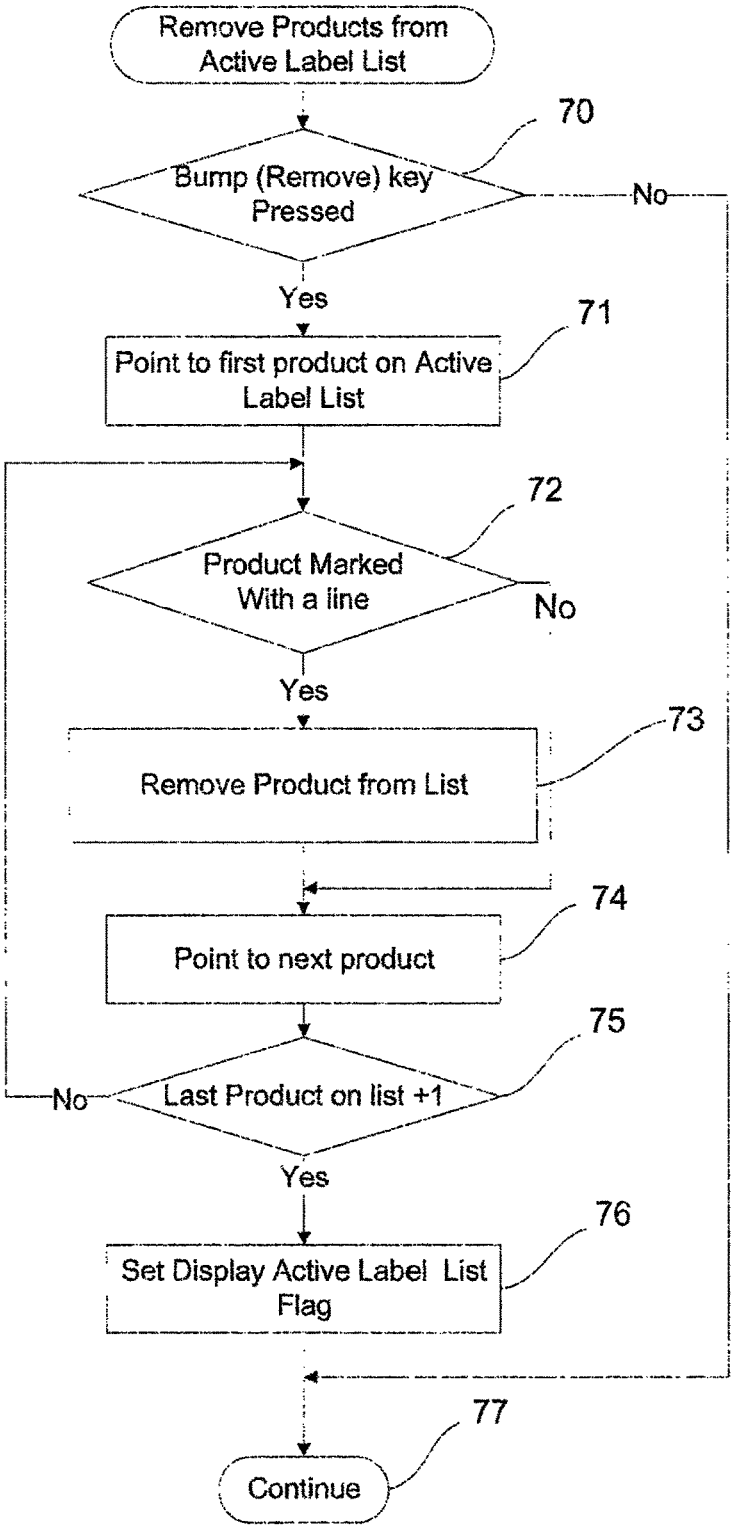
FIG. 3 is the Remove Product from Active Label List functional block diagram or flow chart formed in accordance with the present invention.

The Remove Expired Products From active label List function subroutine 24 checks to see if the user has pressed the "Remove" key and performs the remove expired products from the active Label list function. FIG. 3 details this function.

Figure 4:
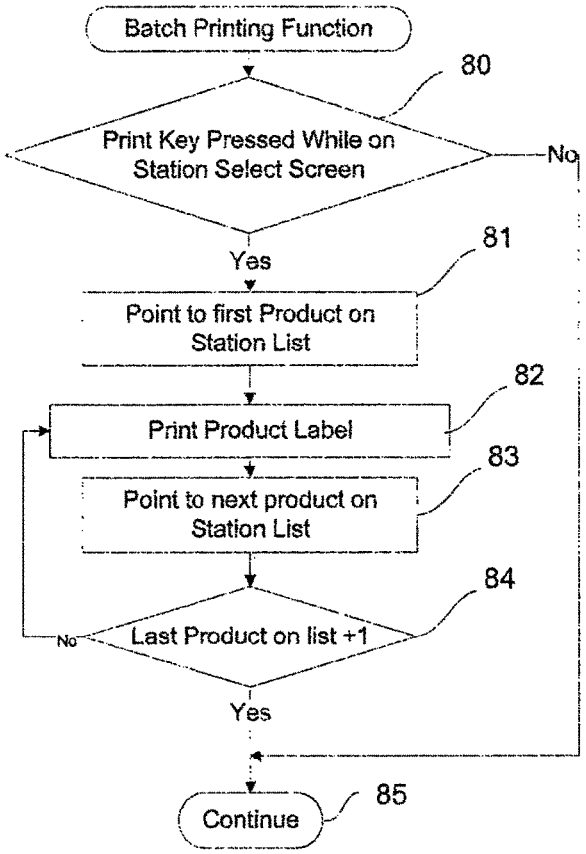
FIG. 4 is the Batch Printing functional block diagram or flow chart formed in accordance with the present invention.
Figure 4A:
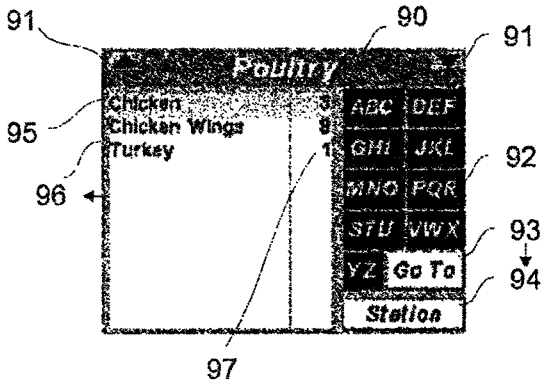
FIG. 4A is the user interface display for batch printing in accordance with the present invention.

The Batch Printing of label Function subroutine 25 checks to see if the user has selected the batch print function, and then if selected, performs the batch printing function when the user presses the print key. FIG. 4 details this function and FIG. 4A is the user interface screen associated with this function.

Figure 5:
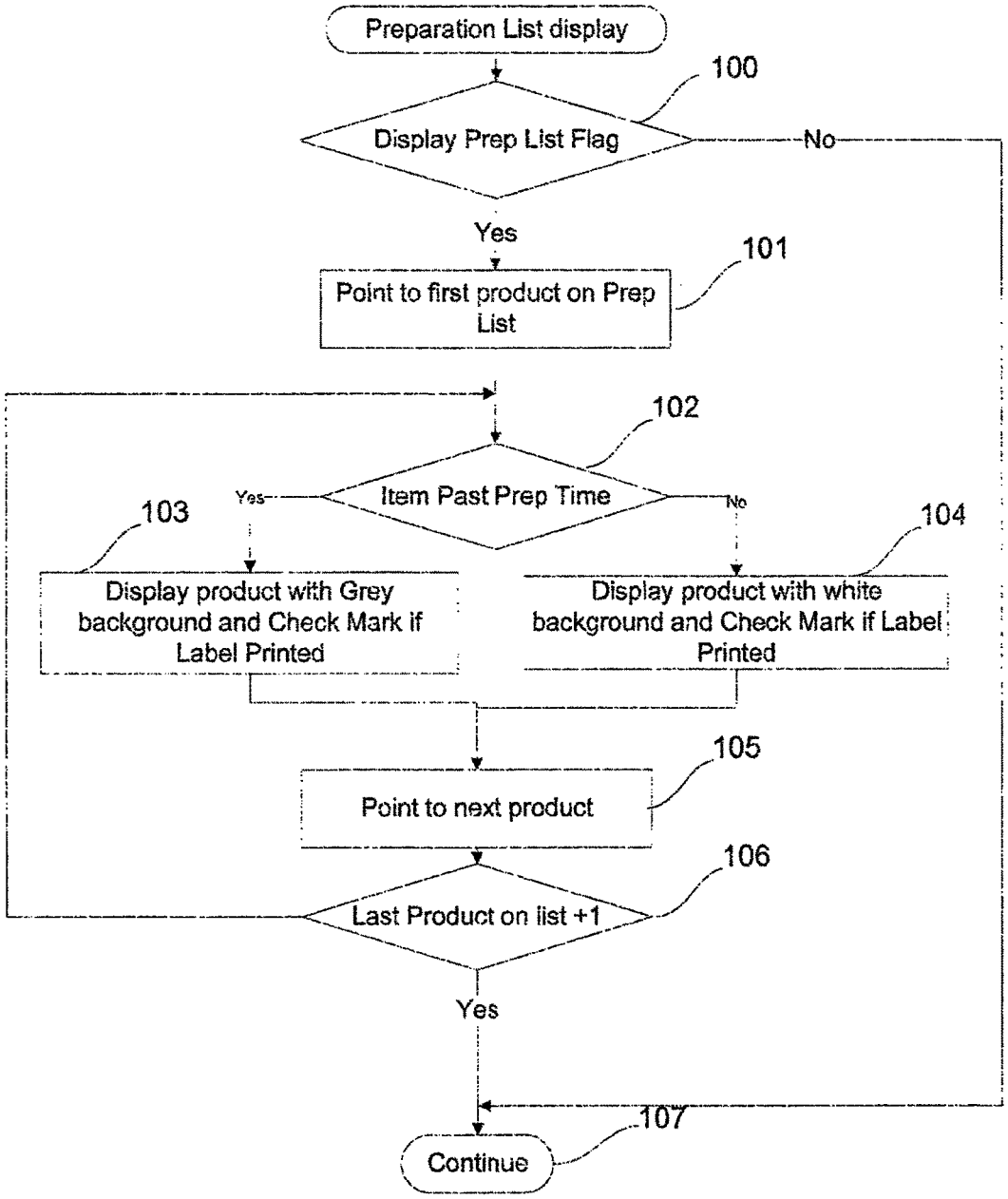
FIG. 5 is the Preparation List display functional block diagram or flow chart formed in accordance with the present invention.

The Prep List Display function subroutine 26 checks to see if it is time to prepare food products, and then if selected, displays the prep list for the user. FIG. 5 details this function.

All other functions 27 that perform standard display, sound, network i/o USB and various library functions are represented by this block.

Detailed Description of FIG. 2B—Print Label Check Functional Block Diagram

The print label check function shown in FIG. 2B performs the label print function and stores information in various places to be used by several objects of the invention. The conditional statement Print Label flag check 30 is used to allow the function to be called from other functions in the program, such as key presses or batch printing. If the Print Label Flag is clear, the control passes to the continue block 34 which returns control to the main loop. If the flag is set, the selected product data block 31 formats the printer data and sends it to the printer. The label information contains product name, user name, and hold time which the device uses to calculate the discard time. The user can program the device with other unique product information to be printed on the label as preparation notes or bar codes.

The Store product information block 32 is then added to the Product Timing List. This list resides in RAM so that it can be accessed quickly, checking for expired product alerts.

The Store product information into Log File on SD card block 33 is the function that stores the product information that was just printed into a log file on the SD card. The log file will be later used in the Label Compliance reporting feature shown in FIG. 6 and FIG. 7.

The software then continues at block 34 back to the main loop to perform the next function.

Detailed Description of FIG. 2C—Expired Product Alert Check Functional Block Diagram The Expired Product Alert Check function searches the active label list to determine if products have expired, and if expired, displays alert screens and sounds. The alert check is controlled by a countdown minute timer block 40. Conditional block 41 checks to see if the Minute timer has reached 0. If the timer is not at zero, the process jumps to the continue block 45. If the timer is at zero, the timer is reset, and the Check List for Expired Products 43 is executed. This block searches through the list of products that are timing, and sets a flag that a new product has expired. Conditional block 43 checks the flag to see if new products have expired, and if products are not expired, the process jumps to the continue block 45. If there are new products that are expired, block 44 is executed, which displays the discard alert screen along with an audible chime Detailed Description of FIG. 2D—Display Product Holding List Functional Block Diagram The Display Product Holding List, also called the Active Label List, shows the user all the products that are on the Active Label list along with the status of each product. Block 50 checks the status of the control flag to see if the list should be displayed. If the flag is set to no, the process jumps to the continue block 58. If the flag is set to yes, the process proceeds to block 51, which sorts the product timing list with the shortest expiration time at the top of the list. Block 52 sets a pointer to the first product on the list. Block 53 tests to see if the product being pointed to has expired. If the product has not expired, block 55 causes the product to be displayed with a white background and no line through the text, as shown at 64 in FIG. 2E. If the product has expired, the block 54 causes the product to be displayed with a red background and a line through the text, as shown at 69 in FIG. 2E. The process continues to block 56, which sets the pointer to the next product on the list. The conditional block 57 checks to see if the last product on the list has been checked, and if no, the process jumps to block 53 to check the remaining products on the list.

Figure 2E:
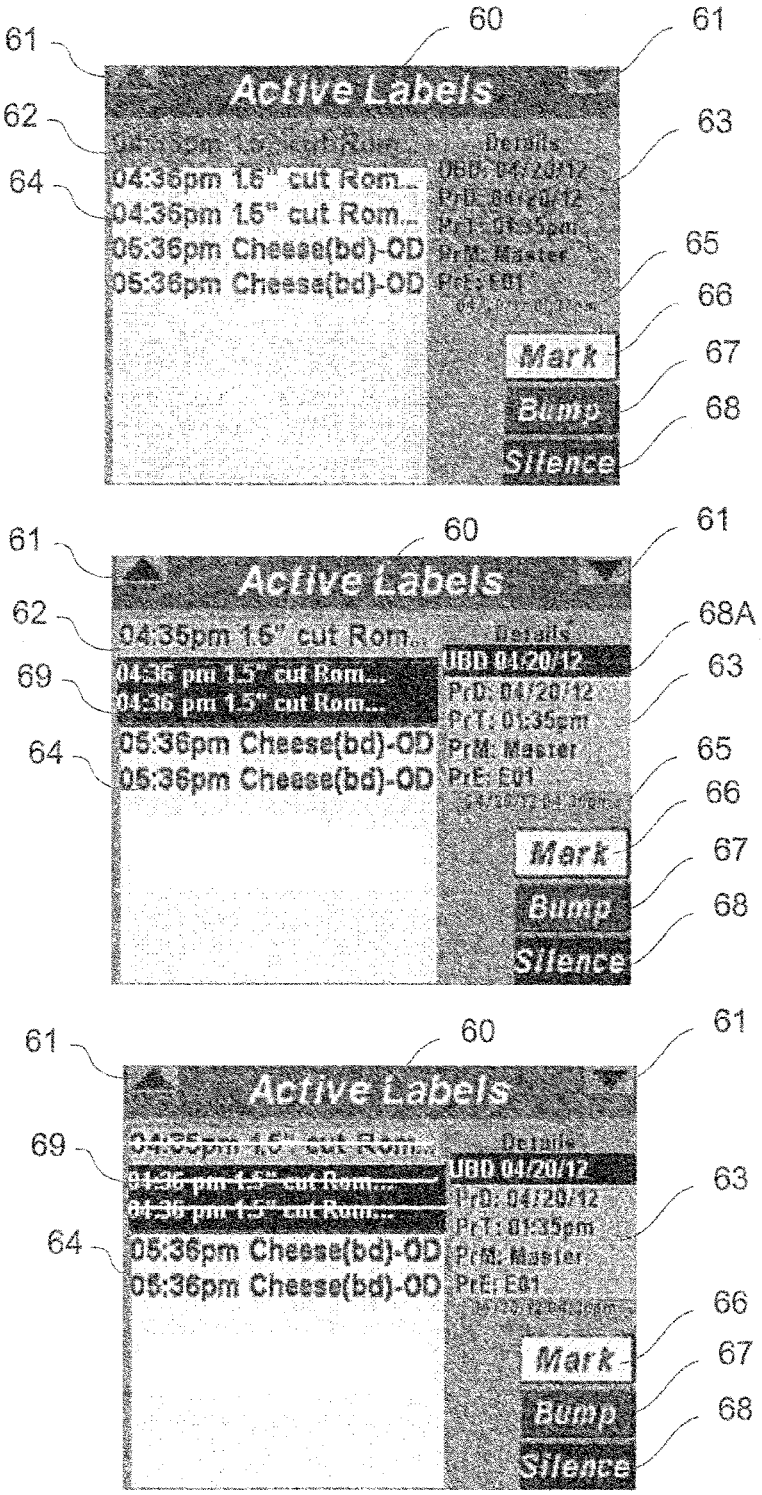
FIG. 2E is the user interface for the display of a product holding list and Discard Alert in accordance with the present invention.

Detailed Description of FIG. 2E—User Interface for Display Product Holding List and Discard Alert FIG. 2E contains several screen shots of the Active Label list that is used to communicate to the user what products are holding and what products have expired. The title 60 of the screen is labeled "Active Labels" and is positioned at the top in a title bar. If the list of active labels cannot fit on one screen, the page arrow keys 61 are used to review the products that are holding. The yellow highlighted product name 62 allows the user to see details of the product, as shown in the Details box 63, or mark the product to be removed from the list using the Mark key 66.

The Details box 63 shows the user the Use By date (UBD), Print Date (PrD), Print Time (PrT), Print Manager's Name, (PrM) and Printed Employee's Name (PrE). The current date and time 65 is shown below the Details box 63. The Details box allows the user to match the product on the Active label list and the label that is attached to the product.

When the real time is greater than the Use By date and time of an item on the active label list, the background color of the item on the list will turn red, as shown at 69. The Details box 63 will also turn red if the item is selected and highlighted yellow, as shown at 68A.

When the Mark Button 66 is pressed, all the items that are over the Use By date and time will be marked with a line through them, as shown at 69. When the Bump key 67 is pressed, all the items that have lines through them will be removed from the Active Label List.

FIG. 2C shows how every minute the software checks to see if any new products have expired. When a new product has expired, the screen will change to the Active Label screen and a sound will chime, as shown in block 44. The Silence key 68 is used to silence the sound.

Detailed Description of FIG. 3—Remove Products from Active Label List Functional Block Diagram FIG. 3 shows the software functional block diagram that removes marked products from the Active Label list. The conditional statement block 70 first checks to see if the Bump key 67 is pressed. If the Bump key is not pressed, the conditional statement block jumps to continue block 77. If the Bump key is pressed, the process flows to block 71, which sets a pointer to the first product on the Active Label list. The conditional statement block 72 checks to see if the product is marked to be removed with a line through the product name, as shown at 69 in FIG. 2E. If yes, block 73 removes the product from the Active Label list. If no, the software jumps to block 74, which points to the next product. Conditional statement block 75 checks to see if the last product on the Active Label list has been processed, and if not, jumps back to block 72 to check the next item on the list. If the Last Product has been processed, the next block 76 sets a flag to redisplay the Active Label list. The function ends at the continue block 77.

Detailed Description of FIG. 4—Batch Printing Functional Block Diagram

The batch printing of product rotation labels allows the customer to easily select and print a group of labels with one key press. This is advantageous when a set of labels must be printed on a daily basis, such as labeling condiment bottles each day. The device allows a user to group products into preparation stations. When a user selects a station, he is presented with the products that are only in that station. If the print key is pressed when the station select screen is shown, labels will be printed for all of the products assigned to the station. Conditional block 80 checks that the Station Select screen is showing and the print key is pressed. If no, the software is directed to continue block 85. If yes, the block 81 points to the first product on the station list. The flow proceeds to block 82, printing the label the programmed number of times. The flow proceeds to block 83, which points to the next product on the station list. Conditional statement 84 compares the list pointer to the last production on the list, and if it is not, the flow is directed to block 82. If the pointer is past the last product on the station list, the batch printing is complete and the software flows to continue block 85.

Detailed Description of FIG. 4A—Sample of the User Interface for Batch Printing of Labels FIG. 4A is the user interface for displaying the products assigned to a station for individual selection or to batch print the entire station. The title bar 90 shows the user the station name, which is programmed to Poultry in the figure, as an example.

The following keys are used to select a specific product and are shown for reference. The arrow keys 91 are used to display multiple pages when the number of products extends past one page. The alphabetic keys 92 are used to move the list of products to the first letter of the key pressed. The Go To key 93 allows the user to enter a product name directly. The station key 94 presents the user with a list of stations to select a different station. The product name Chicken 95 is highlighted, for example, and if the select key of the keypad 3 (see FIG. 1) is pressed, the individual product will be selected.

Next to each product name 95 and 96 (e.g., turkey) is a number 97 that represents the quantity of labels that will print if the print key is pressed. The user can touch any of the numbers pointed to at 97 which will present the user with a keypad to adjust the quantity of labels to batch print.

When the user presses the print key on an external keypad 3 (see FIG. 1), the batch print label function (see FIG. 4) will be performed, which will print the number of labels programmed for each of the products in the segregated list.

Detailed Description of FIG. 5—Preparation List Display Functional Block Diagram The preparation (prep) list is a list of products that a food service worker is required to prepare for the day. The prep list file is sent to the device using the USB port 5 and standard USB thumb drive or the Ethernet connection 9. The list is stored as a file on the SD Card 4.

The preparation list is displayed when the software sets the Display Prep List flag. Conditional statement block 100 checks to see if the flag is set. If no, the conditional statement block 100 jumps to the continue block 107. If yes, the block 101, Point to first product on Prep List, is executed.

Figure 5A:
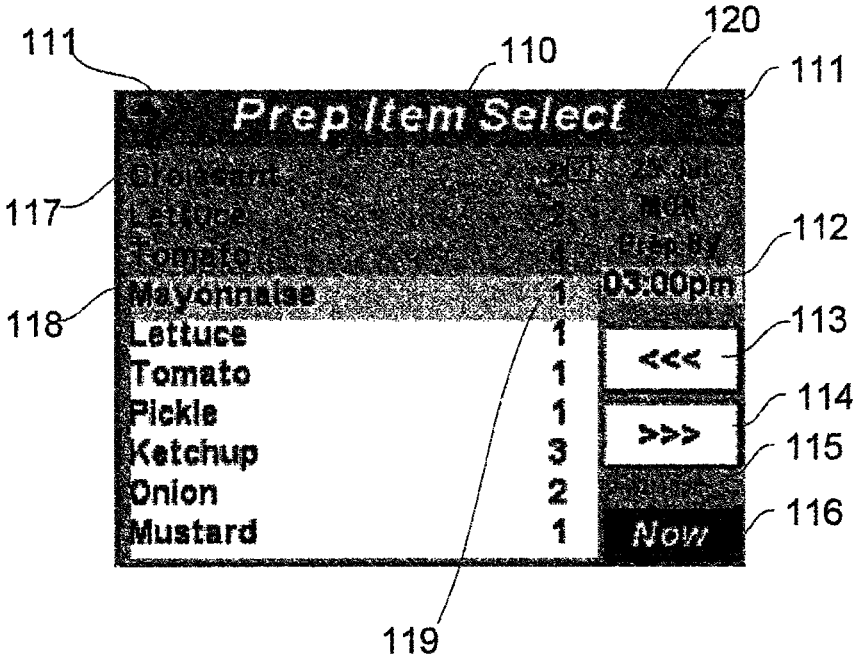
FIG. 5A is the user interface for the display of Preparation Lists in accordance with the present invention.

The prep list is displayed with two background colors, as shown at 117 and 118 in FIG. 5A. A gray background represents that the products are not in the current time range. A white background represents the products that are in the current time period to be prepped. The conditional statement block 102 checks to see if the Item is past the Prep Time. If it is not past the prep time, block 105 displays the product with a white background and displays a check mark 120 next to the product name if the label has been printed. If the item is past the prep time, the background color is set to gray, and if the label has been previously printed, a check mark is placed next to the product name, as shown at 120.

The flow continues to block 105, that sets the pointer to the next product. Conditional statement block 106 checks for the end of the list, and either loops up to display another name or is directed to the continue block 107.

Detailed Description of FIG. 5A—User Interface for the Display of Preparation Lists The Prep Select user interface screen is labeled at the top 110 with the words "Prep Item Select". This screen tells the kitchen staff what products to prepare, as shown at 117 and 118, the quantity to prepare, as shown at 119, and what time to prepare the product, as shown at 112.

The user navigates the screen by using the arrow keys 111 to display products on other pages. Triple arrow keys 113 and 114 shift the display to the first product at the previous or next time period. This allows the user to review products to be prepared or inspect products that have been prepared. The Now key 116 moves the list to the current time period to prepare. The current time 115 is shown to the user as a reference. The "prep by" time 112 displays to the user what time period the product selected needs to be prepared by.

The check mark 120 shows the user that this product and/or a label therefor has been prepared. When the user presses the select key on keypad 3, the product highlighted 118 is selected for printing a label. The user prints the label by pressing the print key on keypad 3; the function 21 is then executed, and a check mark 120 is placed next to the product name.

Figure 6:
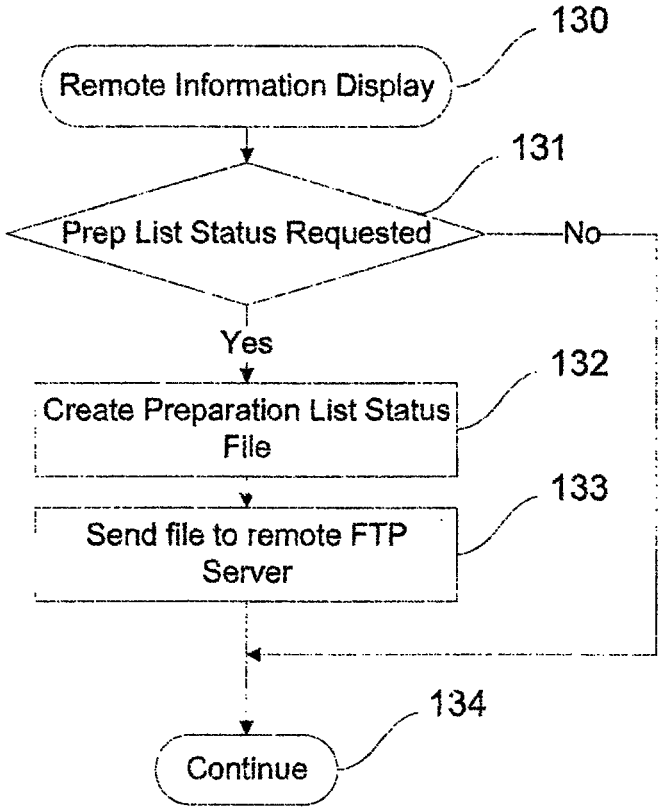
FIG. 6 is the Remote Information display functional block diagram or flow chart formed in accordance with the present invention.

Detailed Description of FIG. 6—The Remote Information Display Functional Block Diagram The status of the prep list is important to the manager of the kitchen to insure that products are being prepared in a timely manner. When the prep list status is requested through the network Ethernet connection 9, a Prep List Status Request flag is set. The remote Information display function 130 is called, and the conditional statement block 131 checks to see if the Prep List Status Request flag is set. If it is not, the flow goes to continue block 134. If it is, a Preparation List status file is created. The file is a copy of the information that is included on the Preparation List User interface shown in FIG. 5A. The Product name, quantity to prep, the check mark who prepared the product and the date and time the product was prepared are placed into a file.

The flow passes to block 133, and the software in the device makes an FTP (File Transfer Protocol) server connection to the remote device. The file is then transferred to the remote device. The remote device can then display to the user the status of the products already prepared and the products left to prepare.

Figure 7:
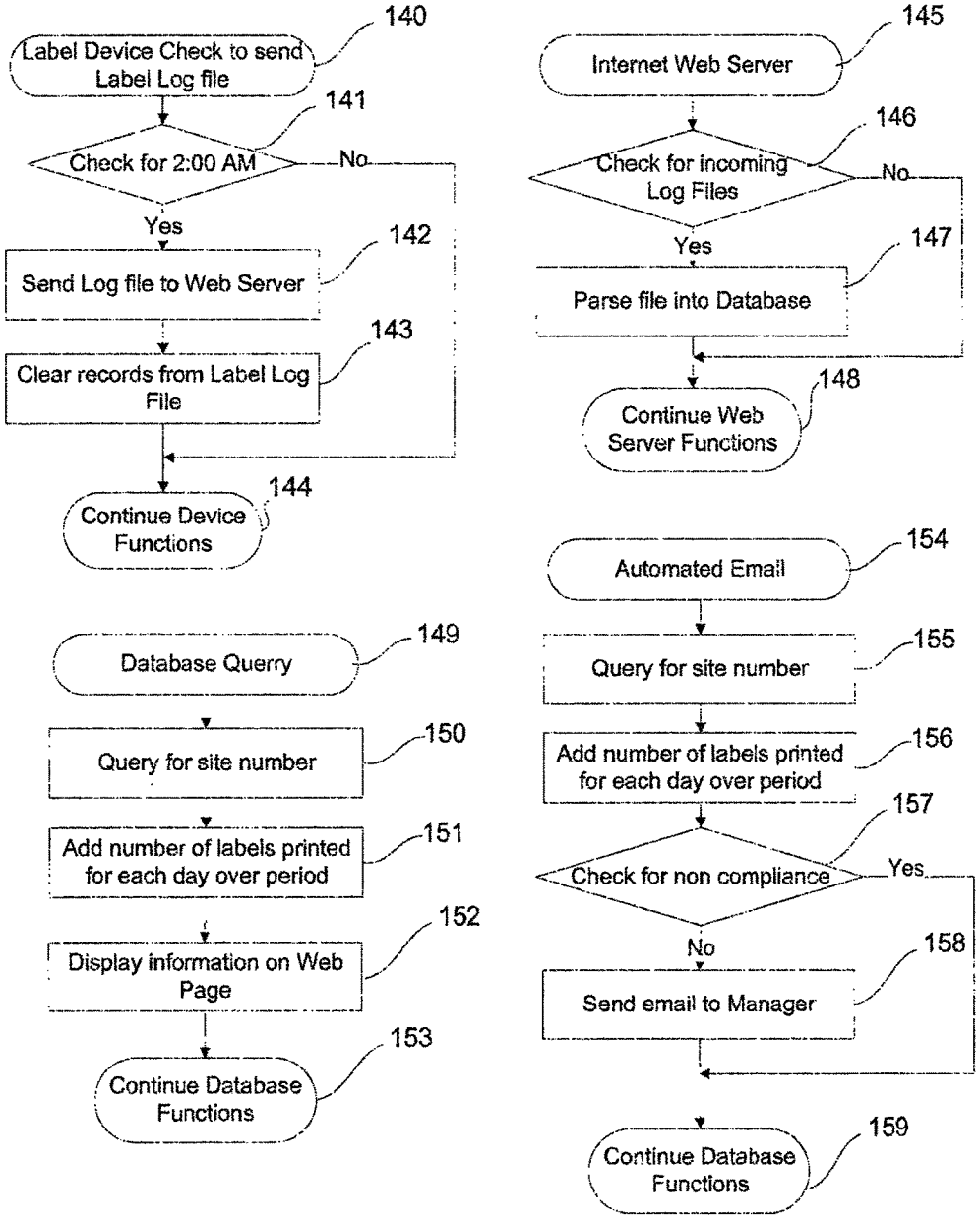
FIG. 7 is the Label Compliance System functional block diagram or flow chart formed in accordance with the present invention.

Detailed Description of FIG. 7—The Label Compliance System Functional Block Diagram The Label compliance and reporting system reports how well products are being labeled throughout an enterprise. FIG. 7 shows that there are three main blocks to insure label compliance.

When a label prints, as referenced in FIG. 2B, the device logs the product information into a Label log file in block 33 and onto the SD Card 4. The block 140 is the start of the function that checks to see if it is time to send log files to a web server. Conditional statement block 141 checks to see if it is 2:00 am (or any other programmable time). If it is not at the send time, the continue block 144 loops back to the device main loop, as shown in FIG. 2A. If the current time is at the 2:00 am set send time, the device makes a standard FTP connection to an Internet Web Server 145 and sends the log file to the web server. The block 143 clears the old records from the label log file.

The Internet Web Server 145 is a server preferably located off premises that is connected to the internet and that continually checks for FTP connections. Conditional block 146 shows the web server checking for incoming Label log files. If no new files are deposited on the web server, the flow goes to block 148, which continues to perform the other web server functions. If a new log file is deposited on the server from a device from block 140, the web server parses the file into an SQL database in block 147. The web server then proceeds to continue block 148, where it continues performing its other functions.

The web server also performs an on demand reporting function. When an internet browser logs into the server, a report query is performed at block 149. The block 150 query filters for site number and totals the number of labels printed for each day over a time period. Block 152 displays the information on the user's browser. The report performs calculations and comparisons that are used by management to insure label compliance, as will be detailed in FIG. 7B. Database functions are then continued (see block 153).

Block 154 starts the automated email function. Block 155 performs the query for site number, and block 156 totals the number of labels printed for the day before. The conditional statement block 157 checks to see if the site is in label compliance. Label compliance level can be set by the user as a percentage of the average number of labels of the last seven days, for example.

Example: Average number of labels printed over 7 days equals 100. Percentage of average is set to 50 percent. Any day that prints less than 50 labels is not in compliance, and any day that is in compliance is equal to or greater than 50 labels printed. This formula allows for variations in usage from day to day.

If the site is found to be out of compliance, an email is sent to the manager for corrective action (see block 158). If a site is found to be out of compliance for two consecutive days, for example, an email is sent to a district manager for corrective action. The escalation of emails can continue based on the user requirements. Database functions are then continued (see block 159).

Figures 7B, 8:
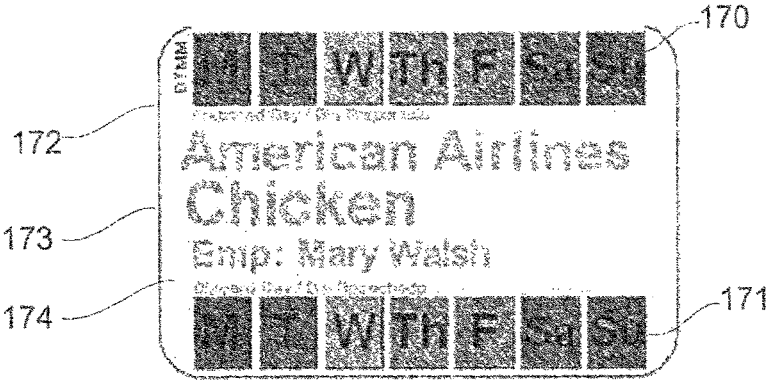
FIG. 7B is a sample of the Label Compliance reports generated by the system and method of the present invention.
FIG. 8 is a sample of the Dual Day of Week color label generated by the system and method of the present invention.

Detailed Description of FIG. 7B—a Sample of the Label Compliance Reports

The Label Compliance Report is displayed to the user on demand by signing onto a label compliance web site. The header 160 is a range of dates that can be set by the user. The example report shows the dates from May 30 back to May 24. The store/site numbers are displayed at 161 on the left side of the report. The number of days (7) that the report is displaying 164 is shown at the top of the report. The allowable variance is set to 30%, as pointed out at 163. The two numbers in the report for each day and each store number are the total labels printed for the day and the average number of labels over the last 7 days. The example at 161 shows 233 labels printed for store 300 on May 30. This is compared to the 7 day average of 345 labels. The number 233 is preferably printed in red because it is under 30% of the 7 day average.

Detailed Description of FIG. 8—a Sample of the Dual Day of Week Color Label

The dual day of week label is printed with colored boxes on the top and bottom of the label. Reference numbers 170 and 171 show a sequence of colored boxes with abbreviations of the days of the week printed inside for user reference. The label is coated with a standard industry chemical that will turn black when exposed to the heat of a direct thermal print head.

When the user selects the product, the device will blank out all of the colored boxes except for one of the top boxes representing today's day of week and one of the bottom boxes representing the discard day of week.

Information that the user requires is printed on the label, such as Customer name, Product name and Employee name, at 173. Indicia at 172 reminds the user that the top day of week colored box is the prepared day and indicia 174 reminds the user that the bottom day of week colored box is the discard day. The reminders can be either in English or in Spanish, or any other language.

The food product rotation label device, and method of preparing food product labels and monitoring their preparation, will now be again described.

A food product rotation label device for preparing food product labels and monitoring the preparation thereof, formed in accordance with the present invention, preferably includes a microcontroller circuit 1; a display 2 electrically coupled to the microcontroller circuit 1, the display 2 displaying information to a user of the device relating to the preparation of food product labels; and a printer 7, the printer 7 being electrically coupled to the microcontroller circuit 1, the printer 7 printing food product labels for attachment to food products. Preferably, the printer 7 is or includes a thermal printer for printing the food product labels.

Preferably, the microcontroller circuit 1 includes a storage circuit 1*a*. The storage circuit 1*a* stores a list of food product label information relating to food product labels printed by the printer 7 and food products on which the food product labels are used. Preferably, the stored list includes the times when the food product labels are printed and expiration times when the food products on which the food product labels are used should be discarded.

The microcontroller circuit 1 generates an alert signal when at least one of the food products on the stored list corresponding to a respective food product label has reached the expiration time thereof and should be discarded. The alert signal is provided to the display 2, and the display 2 displays a visual alert to the user of the device in response to the alert signal that the at least one food product should be discarded. Alternatively, or additionally, the food product rotation label device may include an audible device, such as a speaker 8, electrically coupled to the microcontroller circuit 1, wherein the alert signal is provided to the audible device 8, the audible device 8 sounding an audible alert to the user of the device in response to the alert signal that the at least one food product should be discarded.

The food product rotation label device of the present invention also preferably includes a user interface device, such as touch screen 2 or keypad 3, the user interface device being electrically coupled to the microcontroller circuit 1 and allowing the user to input commands to the microcontroller circuit to control the operation of the device. For example, the user interface device may be used to selectively input a signal to the microcontroller circuit 1 to remove from the stored list the at least one food product and the food product label information associated therewith.

In another form of the food product rotation label device of the present invention, the microcontroller circuit 1 includes a countdown timer circuit 1*b* and a comparator circuit 1*c*, the countdown timer circuit 1*b* generating a countdown timer signal corresponding to the time remaining before the expiration time of the at least one food product has been reached. The comparator circuit 1*c* is responsive to the countdown timer signal and compares the countdown timer signal to the expiration time of the at least one food product to determine whether the alert signal should be generated.

The food product rotation label device of the present invention also preferably includes a flash memory card port which interfaces with an external flash memory card 4, the flash memory card port being in electrical communication with the storage circuit 1*a*. The storage circuit 1*a* selectively provides signals to the flash memory card port corresponding to the stored list of food products and food product label information associated therewith so as to store the list on the external flash memory card 4.

The microcontroller circuit 1 of the food product rotation label device can selectively sort the food product label information and food products in the stored list in the order of shortest expiration times of the food products.

The display 2 of the food product rotation label device preferably displays a screen shot corresponding to the stored list of food products and food product label information, and the expiration times of the food products, for viewing by the user of the device. Furthermore, the display 2 can selectively cause the screen shot corresponding to the stored list to include a strikethrough marking 69 (see FIG. 2E) situated over a respective food product shown in the screen shot when the expiration time of the respective food product has been reached. In addition, the display 2 can selectively cause the screen shot corresponding to the stored list to omit therefrom a respective food product previously included on the screen shot and having a strikethrough marking situated thereover.

The display 2 of the food product rotation label device can also selectively display a screen shot having a list of food products associated with a respective food preparation station of a plurality of food preparation stations selected by the user of the device (see FIG. 4A), the printer 7 batch printing food product labels for use with at least one food product from the displayed list of food products selected by the user.

The food product rotation label device of the present invention may also include a storage circuit, such as a flash memory card 4, as mentioned previously. The storage circuit 4 is in electrical communication with the microcontroller circuit 1, the storage circuit 4 storing a preparation list of food products to be prepared by a user of the device. The stored preparation list preferably includes preparation end times associated with the food products and relating to by when the food products are to be prepared. Preferably, the display 2 displays a screen shot corresponding to the stored preparation list of food products to be prepared, and the end preparation times associated with the food products to be prepared (see FIG. 5A).

Even more preferably, the microcontroller circuit 1 determines the existence of at least a first condition in which at least one food product of the stored preparation list of food products to be prepared has not been prepared and the end preparation time associated with the at least one food product has passed, and at least a second condition in which the at least one food product of the stored preparation list of food products has not been prepared and the end preparation time associated with the at least one food product has not passed. The screen shot corresponding to the stored preparation list of food products to be prepared and displayed on the display 2 preferably includes a first color image situated in alignment with the displayed at least one food product if the microcontroller circuit 1 determines that the at least first condition relating to the at least one food product exists, and a second color image situated in alignment with the displayed at least one food product if the microcontroller circuit 1 determines that the at least second condition relating to the at least one food product exists, the first color image being different in color from the color of the second color image. Also, the screen shot corresponding to the stored preparation list of food products to be prepared and displayed on the display 2 selectively includes an indication 120 in proximity to the at least one food product as to whether a food product label associated with the at least one food product has been prepared.

The food product rotation label device of the present invention preferably also includes an internet and/or ethernet connector 9, the internet and/or ethernet connector 9 being in electrical communication with the storage circuit 1*a* or 4, the storage circuit selectively providing signals to the internet and/or ethernet connector 9 corresponding to the stored preparation list of food products to be prepared so that the preparation list may be transmitted over an internet or ethernet data communications network 12 to a remotely located display and be displayed thereon.

In another form of the present invention, a food product label compliance and reporting system is provided, which includes at least one food product rotation label device for preparing food product labels, such as described previously, and an internet and/or ethernet web server 11. The internet and/or ethernet web server 11 is in signal communication with the at least one food product rotation label device through an internet and/or ethernet connection 12 thereto. The at least one food product rotation label device periodically provides the web server 11, through the internet and/or ethernet connection 12 thereto, data corresponding to the number of labels printed by the at least one food product rotation label device over a first predetermined period of time. From this data, the web server 11 determines a label compliance level by calculating the average number of labels printed by the at least one food product rotation label device and multiplying the average number by a predetermined percentage. The web server 11 then determines if the at least one food product rotation label device is in compliance or not in compliance by comparing the calculated label compliance level with the number of labels printed by the at least one food product rotation label device over a second predetermined period of time (which may be the same as, or different from, the first predetermined period of time). Then, the web server 11 generates a compliance report (see FIG. 7B) based on the compliance determination made by the web server 11 relating to whether the at least one food product rotation label device is in compliance or not in compliance over the second predetermined period of time.

Preferably, the printer 7 of the food product rotation label device described previously prints at least one dual day of week food product label, such as shown in FIG. 8. The at least one dual day of week food product label preferably includes a first portion, and a second portion, the second portion being situated on the dual day of week food product label opposite to the first portion. The first portion of the dual day of week food product label includes a first sequence of boxes 170, each box of the first sequence 170 having an indicia situated therein which indicates one respective day of a week. Selective boxes of the first sequence are blanked out by the printer 7, and at least one box of the first sequence 170 is not blanked out by the printer 7, thereby allowing the indicia situated therein to be viewable by the user. The boxes of the first sequence 170 represent the day of the week the label is printed.

The second portion of the dual day of week food product label shown in FIG. 8 includes a second sequence of boxes 171, each box of the second sequence 171 having an indicia situated therein which indicates one respective day of a week. Selective boxes of the second sequence 171 are blanked out by the printer 7, and at least one box of the second sequence 171 is not blanked out by the printer 7, thereby allowing the indicia situated therein to be viewable by the user. The boxes of the second sequence 171 represent the day of the week that food product on which the label is to be attached should be discarded.

The present invention also relates to a method for preparing food product labels and monitoring the preparation thereof. The method preferably includes the step of printing a food product label using a food product rotation label device, the food product rotation label device including a microcontroller circuit 1; a display 2 electrically coupled to the microcontroller circuit 1; and a printer 7 electrically coupled to the microcontroller circuit 1, such as shown in FIG. 1; and the step of displaying on the display 2 information to a user of the food product rotation label device relating to the preparation of food product labels. As mentioned previously, the microcontroller circuit 1 of the food product rotation label device preferably includes a storage circuit 1*a*, whereby the method of the present invention further includes the step of storing in the storage circuit 1*a* a list of food product label information relating to food product labels printed by the printer 7 and food products on which the food product labels are used, the stored list including the times when the food product labels are printed and expiration times when the food products on which the food product labels are used should be discarded. Preferably, the printer 7 used in the method is a thermal printer.

Preferably, the method described above further includes the steps of generating by the microcontroller circuit 1 an alert signal when at least one of the food products on the stored list corresponding to a respective food product label has reached the expiration time thereof and should be discarded, providing the alert signal generated by the microcontroller circuit 1 to the display 2, and displaying on the display 2*a* visual alert to the user of the device in response to the alert signal that the at least one food product should be discarded. Alternatively, or additionally, the food product rotation label device may further include an audible device 8 electrically coupled to the microcontroller circuit 1, and the method may thus further include the steps of providing the alert signal generated by the microcontroller circuit 1 to the audible device 8, and sounding by the audible device 8 an audible alert to the user of the food product rotation label device in response to the alert signal that the at least one food product should be discarded.

As mentioned previously, the food product rotation label device may further includes a user interface device, such as a touch screen display 2 or a keypad 3, which is electrically coupled to the microcontroller circuit 1, so that the method of the present invention accordingly further includes the step of providing command signals by the user interface device to the microcontroller circuit 1 to control the operation of the food product rotation label device. Even more preferably, the method further includes the steps of selectively providing a signal by the user interface device 2 or 3 to the microcontroller circuit 1, and removing from the stored list the at least one food product and food product label information associated therewith by the microcontroller circuit 1 in response to the signal from the user interface device.

As also described previously, the microcontroller circuit 1 of the food product rotation label device used in the method may include a countdown timer circuit 1*b* and a comparator circuit 1*c*. Accordingly, the method of the present invention may further include the steps of generating by the countdown timer circuit 1*b* a countdown timer signal corresponding to the time remaining before the expiration time of the at least one food product has been reached, and comparing by the comparator circuit 1*c* the countdown timer signal to the expiration time of the at least one food product to determine whether the alert signal should be generated.

As mentioned previously, the food product rotation label device used in the method of the present invention for preparing food labels may include a flash memory card port which interfaces with an external flash memory card 4, the flash memory card port being in electrical communication with the storage circuit 1*a*. Thus, the method may further include the steps of selectively providing by the storage circuit 1*a* signals to the flash memory card port corresponding to the stored list of food products and food product label information associated therewith, and storing on the flash memory card 4 the list of food products and food product label information associated therewith.

The method of the present invention also may include the step of selectively sorting by the microcontroller circuit 1 the food product label information and food products in the stored list in the order of shortest expiration times of the food products.

In accordance with another form of the invention, the method of preparing food product labels described previously may further include the step of displaying on the display 2 a screen shot corresponding to the stored list of food products and food product label information, and the expiration times of the food products, for viewing by the user of the food product rotation label device. This step of displaying a screen shot corresponding to the stored list of food products and food product label information may include the sub-step of displaying by the display 2 the screen shot as including a strikethrough marking situated over a respective food product shown in the screen shot when the expiration time of the respective food product has been reached. Furthermore, the step of displaying the screen shot corresponding to the stored list of food products and food product label information may further include the sub-step of omitting from the screen shot displayed on the display 2 a respective food product previously included on the screen shot and having a strikethrough marking situated thereover.

The method of preparing food product labels in accordance with the present invention, using the food product rotation label device described previously, may include the steps of selectively displaying on the display 2 a screen shot having a list of food products associated with a respective food preparation station of a plurality of food preparation stations selected by the user of the food product rotation label device, and batch printing by the printer 7 food product labels for use with at least one food product from the displayed list of food products selected by the user. As also mentioned previously, the food product rotation label device used in the method may include a storage circuit, such as the flash memory card 4, the storage circuit being in electrical communication with the microcontroller circuit. Accordingly, the method of the present invention may further include the step of storing in the storage circuit 4 a preparation list of food products to be prepared by a user of the food product rotation label device, the stored preparation list including preparation end times associated with the food products and relating to by when the food products are to be prepared.

The method may also include the step of displaying by the display 2 a screen shot corresponding to the stored preparation list of food products to be prepared, and the end preparation times associated with the food products to be prepared. Preferably, the method further includes the step of determining by the microcontroller circuit 1 the existence of at least a first condition in which at least one food product of the stored preparation list of food products to be prepared has not been prepared and the end preparation time associated with the at least one food product has passed, and at least a second condition in which the at least one food product of the stored preparation list of food products has not been prepared and the end preparation time associated with the at least one food product has not passed.

In a preferred version of the method of the present invention, the step of displaying on the display a screen shot corresponding to the stored preparation list of food products to be prepared further includes the sub-step of displaying on the display 2 in the screen shot a first color image situated in alignment with the displayed at least one food product if the microcontroller circuit 1 determines that the at least first condition relating to the at least one food product exists, and a second color image situated in alignment with the displayed at least one food product if the microcontroller circuit 1 determines that the at least second condition relating to the at least one food product exists, the first color image having a different color than the color of the second color image. Also, the step of displaying on the display the screen shot corresponding to the stored preparation list of food products to be prepared may further include the sub-step of selectively displaying on the display 2 in the screen shot an indication 120 in proximity to the at least one food product as to whether a food product label associated with the at least one food product has been prepared.

In an alternative embodiment, the method of preparing food product labels and monitoring the preparation thereof includes the steps of transmitting by the food product rotation label device over an internet or ethernet data communications network 12 in electrical communication with the food product rotation label device signals corresponding to the stored preparation list of food products to be prepared to a remotely located display, and displaying on the remotely located display a screen shot corresponding to the transmitted preparation list of food products to be prepared. Or, or in addition to the above steps, the method may further include the steps of electrically communicating signals from the food product rotation label device to a web server 11, the signals including data corresponding to the number of labels printed by the food product rotation label device over a first predetermined period of time; determining by the web server 11 a label compliance level by calculating the average number of labels printed by the food product rotation label device and multiplying the average number by a predetermined percentage; determining by the web server 11 if the food product rotation label device is in compliance or not in compliance by comparing the calculated label compliance level with the number of labels printed by the food product rotation label device over a second predetermined period of time; and generating by the web server 11 a compliance report based the compliance determination made by the web server 11 relating to whether the food product rotation label device is in compliance or not in compliance over the second predetermined period of time (which may be the same as, or different from, the first predetermined period of time).

In accordance with the method of the present invention, in a preferred form, the step of printing a food product label further includes the sub-step of printing at least one dual day of week food product label, the at least one dual day of week food product label including a first portion, and a second portion, the second portion being situated on the dual day of week food product label opposite to the first portion, as described previously and shown in FIG. 8 of the drawings.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A food product rotation label device for preparing food product labels and monitoring the preparation thereof, which comprises:

a microcontroller circuit;

a display electrically coupled to the microcontroller circuit, the display displaying information to a user of the device relating to the preparation of food product labels;

a printer, the printer being electrically coupled to the microcontroller circuit, the printer printing food product labels for attachment to food product; and a storage circuit, the storage circuit being in electrical communication with the microcontroller circuit, the storage circuit storing a list of food products or a preparation list of food products to be prepared by a user of the device;

wherein the display selectively displays a screen shot having a list of food products associated with a respective food preparation station of a plurality of food preparation stations selected by the user of the device, and a number representing the quantity of labels desired to be printed for each food product of the list of food products associated with the food preparation station selected by the user to be displayed, the number of labels to be printed associated with each displayed food product being changeable by the user on the display, the printer batch printing food product labels in accordance with the displayed changeable number for use with at least one food product from the displayed list of food products associated with the food preparation station selected by the user.

2. A food product rotation label device as defined by claim 1, wherein the storage circuit stores a list of food product label information relating to food product labels printed by the printer and food products on which the food product labels are used, the stored list including the times when the food product labels are printed and expiration times when the food products on which the food product labels are used should be discarded.

3. A food product rotation label device as defined by claim 1, wherein the stored preparation list includes preparation end times associated with the food products and relating to by when the food products are to be prepared.

4. A food product rotation label device as defined by claim 1, wherein the storage circuit includes a flash memory card.

5. A food product rotation label device as defined by claim 1, which further comprises:

an internet and/or ethernet connector, the internet and/or ethernet connector being in electrical communication with the storage circuit, the storage circuit selectively providing signals to the internet and/or ethernet connector corresponding to the stored preparation list of food products to be prepared so that the preparation list may be transmitted over an internet or ethernet data communications network to a remotely located display and be displayed thereon.

6. A food product label compliance and reporting system, which comprises:

at least one food product rotation label device for preparing food product labels as defined by claim 1; and an internet and/or ethernet web server, the internet and/or ethernet web server being in signal communication with the at least one food product rotation label device through an internet and/or ethernet connection thereto;

wherein the at least one food product rotation label device periodically provides the web server, through the internet and/or ethernet connection thereto, data corresponding to the number of labels printed by the at least one food product rotation label device over a first predetermined period of time;

wherein the web server determines a label compliance level by calculating the average number of labels printed by the at least one food product rotation label device and multiplying the average number by a predetermined percentage;

wherein the web server determines if the at least one food product rotation label device is in compliance or not in compliance by comparing the calculated label compliance level with the number of labels printed by the at least one food product rotation label device over a second predetermined period of time; and wherein the web server generates a compliance report based on the compliance determination made by the web server relating to whether the at least one food product rotation label device is in compliance or not in compliance over the second predetermined period of time.

7. A food product rotation label device as defined by claim 1, wherein the printer prints at least one dual day of week food product label, the at least one dual day of week food product label including:

a first portion; and a second portion, the second portion being situated on the dual day of week food product label opposite to the first portion;

wherein the first portion of the dual day of week food product label includes a first sequence of boxes, each box of the first sequence having an indicia situated therein which indicates one respective day of a week, selective boxes of the first sequence being blanked out by the printer, and at least one box of the first sequence not being blanked out by the printer, thereby allowing the indicia situated therein to be viewable by the user, the boxes of the first sequence representing the day of the week the label is printed; and wherein the second portion of the dual day of week food product label includes a second sequence of boxes, each box of the second sequence having an indicia situated therein which indicates one respective day of a week, selective boxes of the second sequence being blanked out by the printer, and at least one box of the second sequence not being blanked out by the printer, thereby allowing the indicia situated therein to be viewable by the user, the boxes of the second sequence representing the day of the week that food product on which the label is to be attached should be discarded.

8. A method for preparing food product labels and monitoring the preparation thereof, which comprises the steps of:

printing a food product label using the food product rotation label device as defined by claim 1; and displaying on the display information to a user of the food product rotation label device relating to the preparation of food product labels.

9. A food product rotation label device as defined by claim 1, wherein the printer is a thermal printer.

10. A food product rotation label device as defined by claim 2, wherein the microcontroller circuit generates an alert signal when at least one of the food products on the stored list corresponding to a respective food product label has reached the expiration time thereof and should be discarded.

11. A food product rotation label device as defined by claim 10, wherein the alert signal is provided to the display, the display displaying a visual alert to the user of the device in response to the alert signal that the at least one food product should be discarded.

12. A food product rotation label device as defined by claim 10, which further comprises:

an audible device electrically coupled to the microcontroller circuit, wherein the alert signal is provided to the audible device, the audible device sounding an audible alert to the user of the device in response to the alert signal that the at least one food product should be discarded.

13. A food product rotation label device as defined by claim 2, which further comprises:

a user interface device, the user interface device being electrically coupled to the microcontroller circuit and allowing the user to input commands to the microcontroller circuit to control the operation of the device.

14. A food product rotation label device as defined by claim 13, wherein the user interface device selectively inputs a signal to the microcontroller circuit to remove from the stored list the at least one food product and the food product label information associated therewith.

15. A food product rotation label device as defined by claim 10, wherein the microcontroller circuit includes a countdown timer circuit and a comparator circuit, the countdown timer circuit generating a countdown timer signal corresponding to the time remaining before the expiration time of the at least one food product has been reached, the comparator circuit being responsive to the countdown timer signal and comparing the countdown timer signal to the expiration time of the at least one food product to determine whether the alert signal should be generated.

16. A food product rotation label device as defined by claim 2, which further comprises:

a flash memory card port which interfaces with an external flash memory card, the flash memory card port being in electrical communication with the storage circuit, the storage circuit selectively providing signals to the flash memory card port corresponding to the stored list of food products and food product label information associated therewith so as to store the list on the external flash memory card.

17. A food product rotation label device as defined by claim 2, wherein the microcontroller circuit selectively sorts the food product label information and food products in the stored list in the order of shortest expiration times of the food products.

18. A food product rotation label device as defined by claim 2, wherein the display displays a screen shot corresponding to the stored list of food products and food product label information, and the expiration times of the food products, for viewing by the user of the device.

19. A food product rotation label device as defined by claim 18, wherein the display selectively causes the screen shot corresponding to the stored list to include a strikethrough marking situated over a respective food product shown in the screen shot when the expiration time of the respective food product has been reached.

20. A food product rotation label device as defined by claim 19, wherein the display selectively causes the screen shot corresponding to the stored list to omit therefrom a respective food product previously included on the screen shot and having a strikethrough marking situated thereover.

21. A food product rotation label device as defined by claim 3, wherein the display displays a screen shot corresponding to the stored preparation list of food products to be prepared, and the preparation end times associated with the food products to be prepared.

22. A food product rotation label device as defined by claim 21, wherein the microcontroller circuit determines the existence of at least a first condition in which at least one food product of the stored preparation list of food products to be prepared has not been prepared and the preparation end time associated with the at least one food product has passed, and at least a second condition in which the at least one food product of the stored preparation list of food products has not been prepared and the preparation end time associated with the at least one food product has not passed.

23. A food product rotation label device as defined by claim 22, wherein the screen shot corresponding to the stored preparation list of food products to be prepared and displayed on the display includes a first color image situated in alignment with the displayed at least one food product if the microcontroller circuit determines that the at least first condition relating to the at least one food product exists, and a second color image situated in alignment with the displayed at least one food product if the microcontroller circuit determines that the at least second condition relating to the at least one food product exists, the first color image being different in color from the color of the second color image.

24. A food product rotation label device as defined by claim 23, wherein the screen shot corresponding to the stored preparation list of food products to be prepared and displayed on the display selectively includes an indication in proximity to the at least one food product as to whether a food product label associated with the at least one food product has been prepared.

25. A method as defined by claim 8, wherein the method further comprises the step of:

storing in the storage circuit a list of food product label information relating to food product labels printed by the printer and food products on which the food product labels are used, the stored list including the times when the food product labels are printed and expiration times when the food products on which the food product labels are used should be discarded.

26. A method as defined by claim 25, which further comprises the step of:

generating by the microcontroller circuit an alert signal when at least one of the food products on the stored list corresponding to a respective food product label has reached the expiration time thereof and should be discarded.

27. A method as defined by claim 26, which further comprises the steps of:

providing the alert signal generated by the microcontroller circuit to the display; and displaying on the display a visual alert to the user of the device in response to the alert signal that the at least one food product should be discarded.

28. A method as defined by claim 26, wherein the food product rotation label device further includes an audible device electrically coupled to the microcontroller circuit; and wherein the method further comprises the steps of:

providing the alert signal generated by the microcontroller circuit to the audible device; and sounding by the audible device an audible alert to the user of the food product rotation label device in response to the alert signal that the at least one food product should be discarded.

29. A method as defined by claim 25, wherein the food product rotation label device further includes a user interface device, the user interface device being electrically coupled to the microcontroller circuit; and wherein the method further comprises the step of:

providing command signals by the user interface device to the microcontroller circuit to control the operation of the food product rotation label device.

30. A method as defined by claim 29, which further comprises the steps of:

selectively providing a signal by the user interface device to the microcontroller circuit; and removing from the stored list the at least one food product and food product label information associated therewith by the microcontroller circuit in response to the signal from the user interface device.

31. A method as defined by claim 26, wherein the microcontroller circuit of the food product rotation label device includes a countdown timer circuit and a comparator circuit; and wherein the method further comprises the steps of:

generating by the countdown timer circuit a countdown timer signal corresponding to the time remaining before the expiration time of the at least one food product has been reached; and comparing by the comparator circuit the countdown timer signal to the expiration time of the at least one food product to determine whether the alert signal should be generated.

32. A method as defined by claim 25, wherein the food product rotation label device further includes a flash memory card port which interfaces with an external flash memory card, the flash memory card port being in electrical communication with the storage circuit; and wherein the method further comprises the steps of:

selectively providing by the storage circuit signals to the flash memory card port corresponding to the stored list of food products and food product label information associated therewith; and storing on the flash memory card the list of food products and food product label information associated therewith.

33. A method as defined by claim 25, which further comprises the step of:

selectively sorting by the microcontroller circuit the food product label information and food products in the stored list in the order of shortest expiration times of the food products.

34. A method as defined by claim 25, which further comprises the step of:

displaying on the display a screen shot corresponding to the stored list of food products and food product label information, and the expiration times of the food products, for viewing by the user of the food product rotation label device.

35. A method as defined by claim 34, wherein the step of displaying a screen shot corresponding to the stored list of food products and food product label information includes the sub-step of:

displaying by the display the screen shot as including a strikethrough marking situated over a respective food product shown in the screen shot when the expiration time of the respective food product has been reached.

36. A method as defined by claim 35, wherein the step of displaying the screen shot corresponding to the stored list of food products and food product label information further comprises the sub-step of:

omitting from the screen shot displayed on the display a respective food product previously included on the screen shot and having a strikethrough marking situated thereover.

37. A method as defined by claim 8, wherein the storage circuit includes a flash memory card.

38. A method as defined by claim 8, which further comprises the step of:

displaying by the display a screen shot corresponding to the stored preparation list of food products to be prepared, and the end preparation times associated with the food products to be prepared.

39. A method as defined by claim 38, which further comprises the step of:

determining by the microcontroller circuit the existence of at least a first condition in which at least one food product of the stored preparation list of food products to be prepared has not been prepared and the end preparation time associated with the at least one food product has passed, and at least a second condition in which the at least one food product of the stored preparation list of food products has not been prepared and the end preparation time associated with the at least one food product has not passed.

40. A method as defined by claim 39, wherein the step of displaying on the display a screen shot corresponding to the stored preparation list of food products to be prepared further includes the sub-step of:

displaying on the display in the screen shot a first color image situated in alignment with the displayed at least one food product if the microcontroller circuit determines that the at least first condition relating to the at least one food product exists, and a second color image situated in alignment with the displayed at least one food product if the microcontroller circuit determines that the at least second condition relating to the at least one food product exists, the first color image having a different color than the color of the second color image.

41. A method as defined by claim 40, wherein the step of displaying on the display the screen shot corresponding to the stored preparation list of food products to be prepared further includes the sub-step of:

selectively displaying on the display in the screen shot an indication in proximity to the at least one food product as to whether a food product label associated with the at least one food product has been prepared.

42. A method as defined by claim 38, which further comprises the steps of:

transmitting by the food product rotation label device over an internet or ethernet data communications network in electrical communication with the food product rotation label device signals corresponding to the stored preparation list of food products to be prepared to a remotely located display; and displaying on the remotely located display a screen shot corresponding to the transmitted preparation list of food products to be prepared.

43. A method as defined by claim 8, which further comprises the steps of:

electrically communicating signals from the food product rotation label device to a web server, the signals including data corresponding to the number of labels printed by the food product rotation label device over a first predetermined period of time;

determining by the web server a label compliance level by calculating the average number of labels printed by the food product rotation label device and multiplying the average number by a predetermined percentage;

determining by the web server if the food product rotation label device is in compliance or not in compliance by comparing the calculated label compliance level with the number of labels printed by the food product rotation label device over a second predetermined period of time; and generating by the web server a compliance report based the compliance determination made by the web server relating to whether the food product rotation label device is in compliance or not in compliance over the second predetermined period of time.

44. A method as defined by claim 8, wherein the step of printing a food product label further includes the sub-step of:

printing at least one dual day of week food product label, the at least one dual day of week food product label including:

a first portion; and a second portion, the second portion being situated on the dual day of week food product label opposite to the first portion;

wherein the first portion of the dual day of week food product label includes a first sequence of boxes, each box of the first sequence having an indicia situated therein which indicates one respective day of a week, selective boxes of the first sequence being blanked out by the printer, and at least one box of the first sequence not being blanked out by the printer, thereby allowing the indicia situated therein to be viewable by the user, the boxes of the first sequence representing the day of the week the label is printed; and wherein the second portion of the dual day of week food product label includes a second sequence of boxes, each box of the second sequence having an indicia situated therein which indicates one respective day of a week, selective boxes of the second sequence being blanked out by the printer, and at least one box of the second sequence not being blanked out by the printer, thereby allowing the indicia situated therein to be viewable by the user, the boxes of the second sequence representing the day of the week that food product on which the label is to be attached should be discarded.

45. A method as defined by claim 8, wherein the printer of the food product rotation label device is a thermal printer.

46. A food product rotation label device as defined by claim 7, wherein the boxes of the first sequence of boxes of the first portion of the dual day of the week food product label and the boxes of the second sequence of boxes of the second portion of the dual day of the week food product label include selected colors to indicate different days of the week.

47. A method as defined by claim 44, wherein the boxes of the first sequence of boxes of the first portion of the dual day of the week food product label and the boxes of the second sequence of boxes of the second portion of the dual day of the week food product label include selected colors to indicate different days of the week.

* * * * *